US008681195B2

(12) United States Patent
Matsushima

(10) Patent No.: US 8,681,195 B2
(45) Date of Patent: Mar. 25, 2014

(54) PAPER DETECTING DEVICE AND PRINTER INCLUDING THE SAME

(75) Inventor: Gen Matsushima, Kiyose (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 59 days.

(21) Appl. No.: 13/354,695

(22) Filed: Jan. 20, 2012

(65) Prior Publication Data

US 2012/0188547 A1 Jul. 26, 2012

(30) Foreign Application Priority Data

Jan. 21, 2011 (JP) ..... 2011-010868

(51) Int. Cl.
*B41J 2/32* (2006.01)

(52) U.S. Cl.
USPC ..... 347/171

(58) Field of Classification Search
USPC ..... 347/171, 172, 213, 215, 217
See application file for complete search history.

(56) References Cited

U.S. PATENT DOCUMENTS

| | | | | |
|---|---|---|---|---|
| 5,585,828 | A * | 12/1996 | Cavarero | 347/171 |
| 7,315,316 | B2 * | 1/2008 | Kitamura et al. | 347/171 |
| 8,159,514 | B2 * | 4/2012 | Takizawa et al. | 347/215 |
| 8,330,781 | B2 * | 12/2012 | Osawa et al. | 347/171 |

FOREIGN PATENT DOCUMENTS

| | | |
|---|---|---|
| JP | 2001-310523 | 11/2001 |
| JP | 2003-146482 | 5/2003 |
| JP | 2008-105856 | 5/2008 |

OTHER PUBLICATIONS

Japanese Office Action mailed Nov. 6, 2012 in corresponding Japanese Patent Application No. 2011-010868.

* cited by examiner

*Primary Examiner* — Kristal Feggins
(74) *Attorney, Agent, or Firm* — Wenderoth, Lind & Ponack, L.L.P.

(57) ABSTRACT

A paper detecting device includes a paper detecting element, and a guide element having a path along which the paper detecting element is moved. At least one of the paper detecting element and the guide element includes an engaging element configured to be movable between an engaging position, at which the paper detecting element is fixed on the path, and a release position, at which the paper detecting element is released from the fixation. A click generator configured to click when the paper detecting element is moved on the path and reaches the correct position to stop.

10 Claims, 8 Drawing Sheets

SECT.A-A

SECT.A-A

SECT. B-B

PAPER DETECTING DEVICE AND PRINTER INCLUDING THE SAME

CROSS REFERENCE TO RELATED APPLICATION

The present application is based on and claims priority from Japanese Patent Application No. 2011-10868, filed on Jan. 21, 2011, the disclosure of which is hereby incorporated by reference in its entirety.

BACKGROUND OF THE INVENTION

1. Field of the Invention

The present invention relates to a paper detecting device and a printer incorporating the paper detecting device, particularly to an improvement in a movable paper detecting device.

2. Description of the Prior Art

A printer generally includes a paper detecting device to detect a paper and paper reference positions in order to properly set paper feed timing and print start/end timing and print information on the paper at the right position while feeding the paper.

This paper detecting device includes a paper detector such as a reflective or transmissive type optical sensor. When mounted in a printer in which papers in different widths are selectively used, the paper detector is set to be movable in paper width direction in line with the type of a paper in use, for example.

A printer dedicated for a single paper size may include the movable paper detector so as to accurately detect black marks indicating paper reference positions which are defined differently depending on a paper.

Such a paper detecting device includes a guide element having a path along which the paper detector is movable or an operator can move it to an appropriate position.

In prior art Japanese Patent Application Publication No. 2003-146482 (Reference 1), for example, discloses a paper detecting device configured to be supported by the guide element via an elastic element. This paper detecting device is fixed in a predetermined position on the guide element by the contact friction of the elastic element, while it can be moved along the path, applied with an operational force against the friction.

Also, Japanese Patent Application Publication No. 2001-310523 (Reference 2) discloses a paper detecting device which includes a paper detector having a protrusion and a guide element with an uneven portion in which concaves and convexes are alternately arranged along the path so that the protrusion is fitted into any of the concaves. Applied with an operational force, the protrusion is released from the engagement and the paper detector is moved along the path while the protrusion is fitted into the convexes in order. With this device, an operator can feel a sense of clicking every time the protrusion is fitted into the concave.

However, the device disclosed in Reference 1 faces a problem that it is difficult to precisely stop the paper detector at a desired position since applied with an initial force to move the paper detector in a still state, it may be moved too far unexpectedly. This occurs because the friction of the elastic element needs to be set relatively large in order to securely stop the paper detector while no force is applied, and dynamic friction as a resistance of the detector moving along the path is smaller than static friction as that of the detector immediately before moving.

Meanwhile, if the elastic element is set to have a small friction, an operator's careless touch may easily move the paper detector and the paper detector cannot be held at a predetermined stop position reliably.

In view of the above problems, the device can be configured to additionally include a friction release mechanism to allow an operator to stop the paper detector at a desired position by removing the frictional resistance with the release mechanism before applying a force to move it. However, this may cause another problem that with no indication or marks for stop positions provided, the operator cannot know the right position to stop the detector so that he or she operates it only by his/her experience or intuition and the desired position at which the operator has stopped the detector may not be actually the right stop position originally set in the device.

Further, in the device disclosed in Reference 2, the concave of the guide element and the protrusion of the paper detector are configured to be relatively strongly engaged with each other to securely hold the paper detector in the stop state.

However, with the concave and the protrusion strongly engaged, the paper detector cannot be smoothly moved when applied with an operational force. In addition, once it starts moving, it may be moved too far, passing over a target stop position. Meanwhile, when the engagement is weak, the paper detector may be unintentionally moved by unexpected contact with another element or an operator's finger or else.

SUMMARY OF THE INVENTION

An object of the present invention is to provide a paper detecting unit and a paper detecting device incorporating the paper detecting unit which can surely stop or fix the paper detecting unit at a desired stop position, and smoothly move it by a simple operation when needed and provide an operator an indication for a proper stop position.

According to one aspect, a paper detecting device includes a paper detecting element and a guide element having a path along which the paper detecting element is moved, wherein at least one of the engaging element and the guide element includes an engaging element configured to be movable between an engaging position at which the paper detecting element is fixed on the path and a release position at which the paper detecting element is released from the fixation, and a click generator configured to click when the paper detecting element is moved on the path to reach a right position to stop.

BRIEF DESCRIPTION OF THE DRAWINGS

Features, embodiments, and advantages of the present invention will become apparent from the following detailed description with reference to the accompanying drawings:

FIG. 4A is a plan view of waveforms formed in a long groove of a guide plate in detail while

FIG. 5A shows the engagement of the upper-side protrusion of the paper detecting device and the upper-side concaves on the inner face of the groove while

FIG. 6A is a cross section view of the paper detecting unit in an engaging position fixed to a guide plate along A to A line in FIG. 3 while

FIG. 7A is a cross section view of the paper detecting unit in a release position released from the fixation with the guide plate along the A to A line in FIG. 3 while FIG. 8A is a cross section view of the paper detecting unit in the engaging position fixed to the guide plate along B to B line in FIG. 3 while

DETAILED DESCRIPTION OF THE PREFERRED EMBODIMENT

Hereinafter, embodiments of a printer and a paper detecting device according to the present invention will be described in detail with reference to the accompanying drawings. Wherever possible, the same reference numbers will be used throughout the drawings to refer to the same or like parts.

Figure 1B:
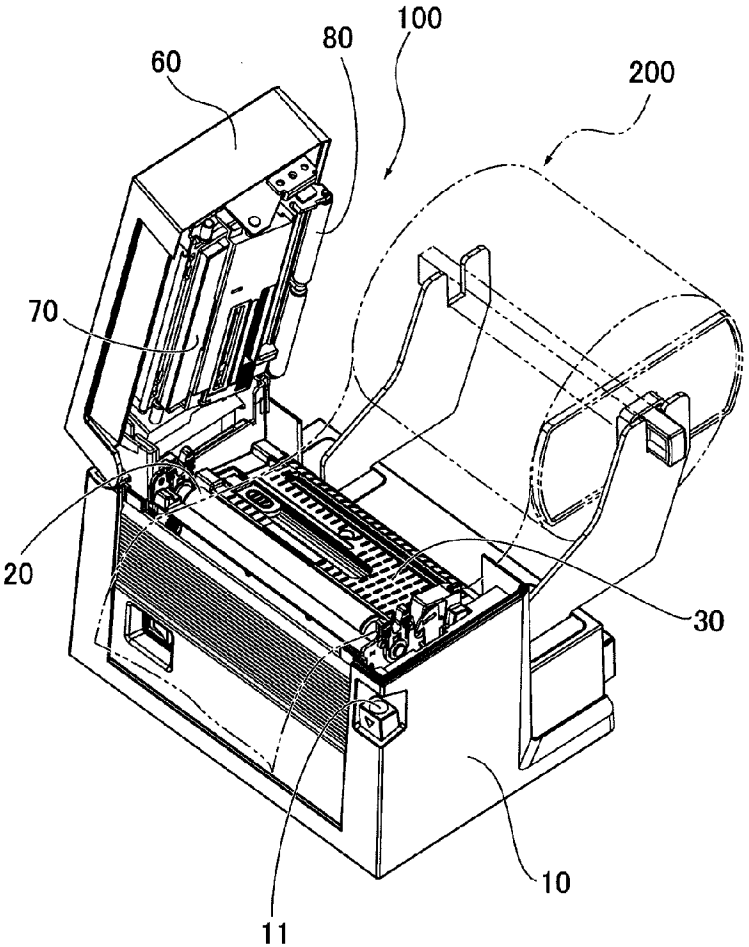
FIG. 1A is a perspective view of a thermal printer as a printer according to one embodiment of the present invention with a cover closed and FIG. 1B shows the same with the cover opened.
Figure 1A:
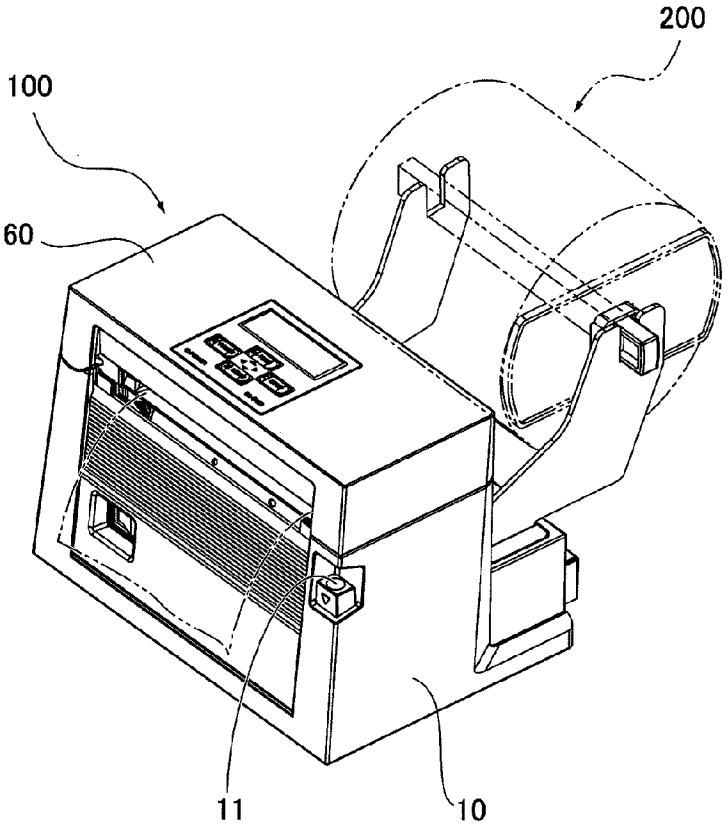

FIGS. 1A, 1B are perspective views of a thermal printer 100 as a printer according to one embodiment of the present invention. With an open/close button 11 on a printer body 10 pressed, a cover 60 is opened sideways as shown in FIG. 1B for replacing a roll paper 200 disposed between the printer body 10 and the cover 60 or maintenance purposes such as inspection or replacement of parts and components inside the printer body 10 and the cover 60.

The printer body 10 includes a paper detecting device 30 having a platen roller 20 and a transmissive type optical sensor (54*a* in FIG. 2) for detecting the roll paper 200.

The cover 60 includes a thermal print head 70 in a portion opposite to the platen roller 20 of the printer body 10 and a guide roller 80 for the roll paper 200 in a portion opposite to the paper detecting device 30.

Figure 2:
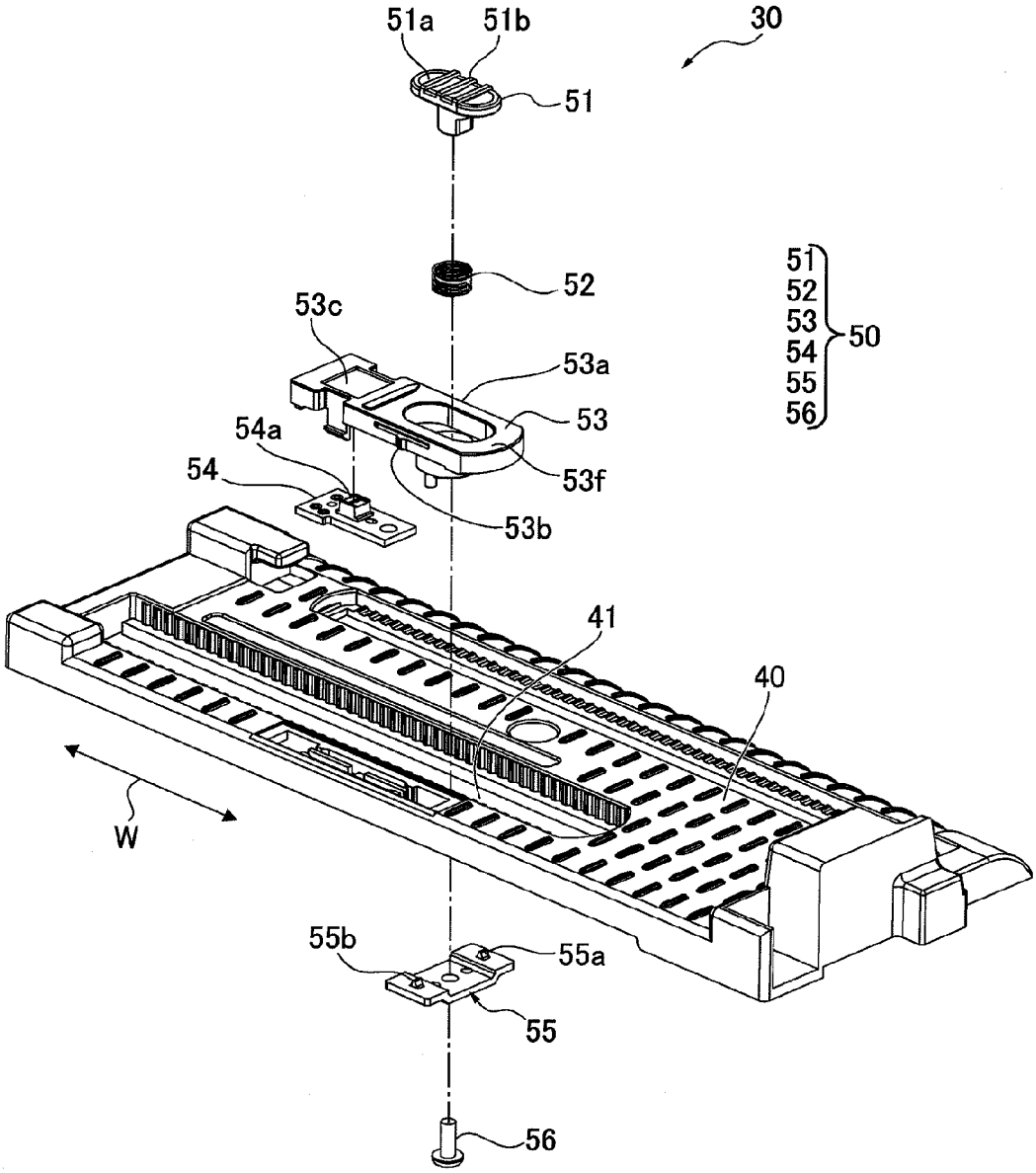
FIG. 2 is an exploded perspective view of a paper detecting device of the thermal printer in FIG. 1.

In FIG. 2 the paper detecting device 30 includes a guide plate 40 as a guide element having a long straight groove 41 as a path extending in paper width direction W and on which the roll paper 200 passes, and a paper detecting unit 50 as a paper detecting element movable along the length of the groove 41 or in the paper width direction W.

In the paper detecting device 30 the paper detecting unit 50 is moved along the length of the long groove 41 to an appropriate position in line with a type (paper width, for example) of the roll paper 200 in use.

Figure 3:
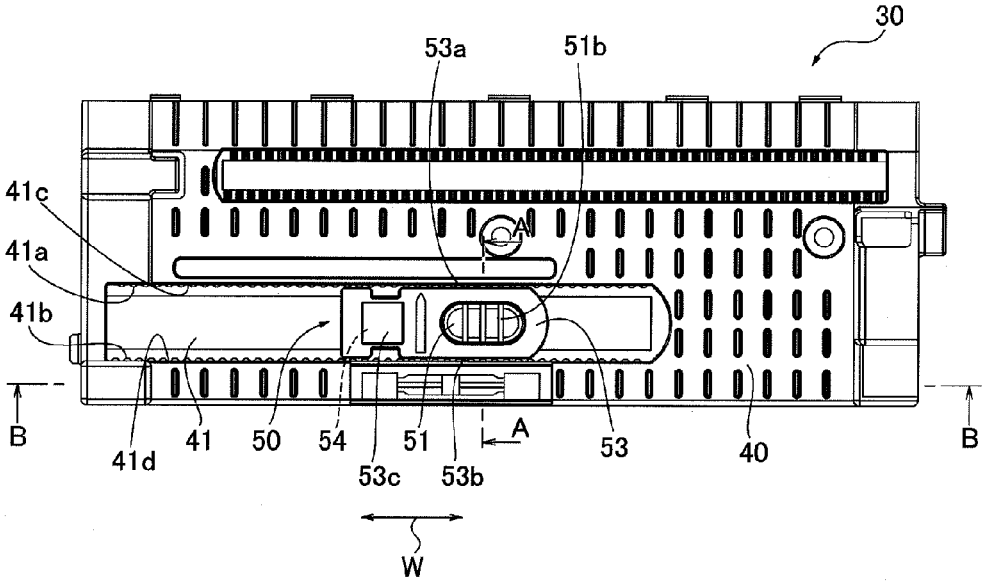
FIG. 3 is a plan view of the paper detecting device in FIG. 2 as seen from above.

The groove 41 of the guide plate 40 includes two waveforms as a click generator and an uneven portion on both sides of the inner surfaces. The two waveforms are formed of convexes 41*a* and concaves 41*c* and convexes 41*b* and concaves 41*d* alternately arranged in the paper width direction W, respectively as shown in FIG. 3. The convexes protrude and the concaves are depressed orthogonally relative to the paper width direction W.

Figure 4A:
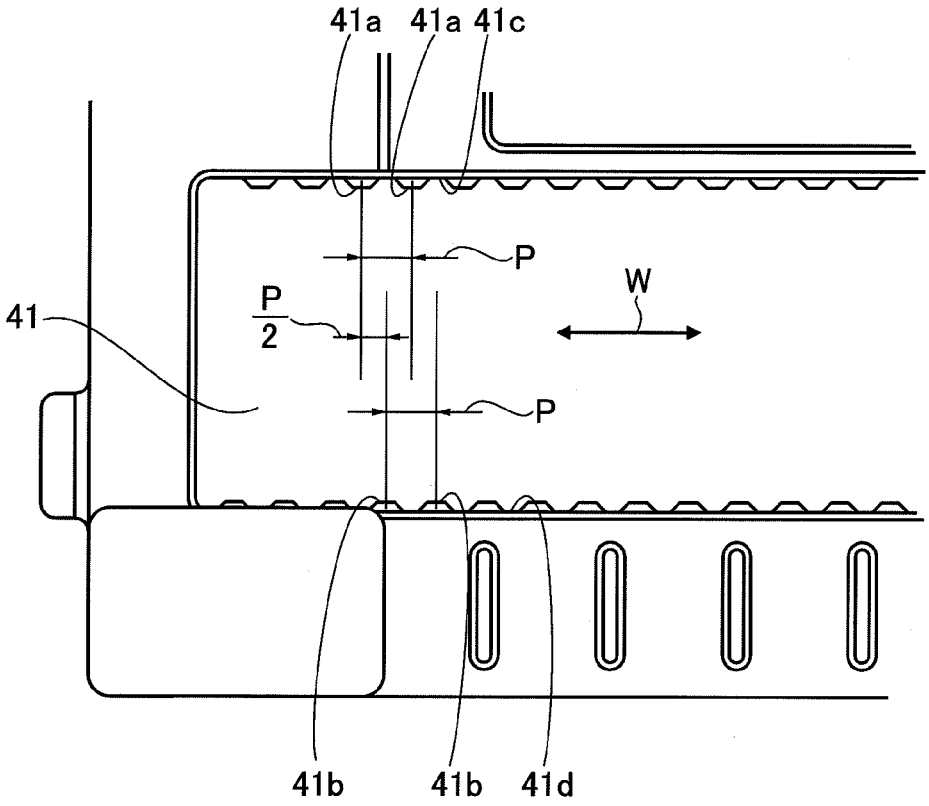

As shown in FIG. 4A, all the convexes 41*a*, 41*b* on both sides are arranged at a certain pitch P but the convexes 41*a* on one side and the convexes 41*b* on the other side are shifted in position by a half pitch P/2 in the paper width direction W.

Specifically, the paper detecting unit 50 includes a base 53 on which a sensor circuit 54 having the optical sensor 54*a* as photo interrupter is fixed, an operation button 51 as operation element configured to be vertically movable relative to the base 53 and to which a vertical force is applied, a latch plate 55 fixed to the operation button 51 via the base 53 and the guide plate 40, a screw 56 to fix the latch plate 55 to the operation button 51, and a coil spring 52 as a bias element disposed between the base 53 and the operation button 51 to bias the operation button 51 upward in the drawing. The operation button 51, latch plate 55, screw 56 constitute an engaging element.

In the present embodiment the optical sensor 54*a* is configured to detect the roll paper 200. Alternatively, it can detect a reference position or portion of the roll paper 200 such as a black mark.

The width of the base 53 is set to be slightly smaller than that of the groove 41 of the guide plate 40 in the longitudinal direction of the roll paper 200.

Figure 4B:
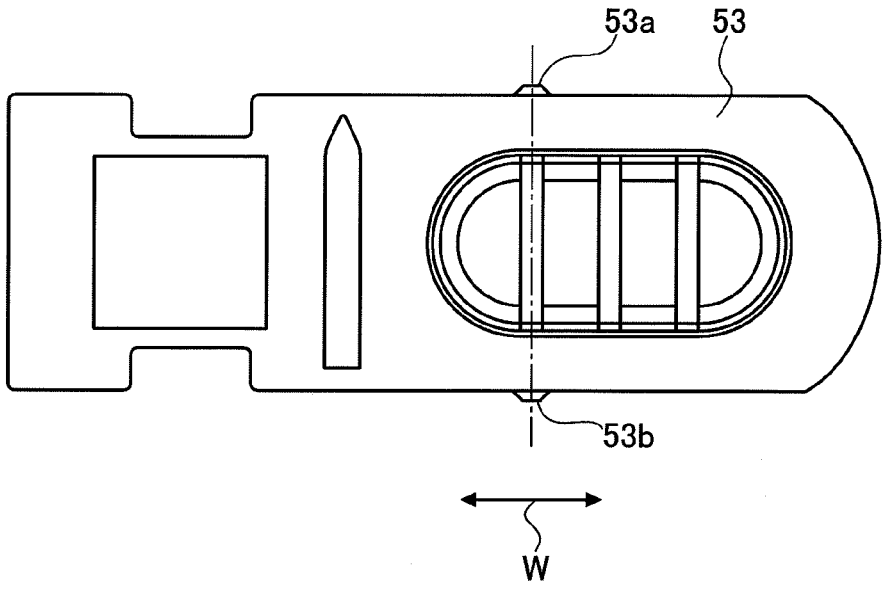
FIG. 4B is a plan view of protrusions formed on a paper detecting unit.

The base 53 includes protrusions 53*a*, 53*b* as a click generator outwardly protruding on the sidewalls which oppose to both the inner surfaces of the groove 41 while the paper detecting unit 50 is mounted in the groove 41 or the length of the base 53 is in line with the width W of the roll paper 200, as shown in FIG. 4B.

Also, notches are formed near the two protrusions 53*a*, 53*b* on the sidewalls of the base 53. Because of the notches, the surrounding areas of the protrusions 53*a*, 53*b* are decreased in rigidity and elastically deformable easily along the width of the base 53.

Therefore, when the protrusions 53*a* 53*b* are applied with a load from outside to inside along the width of the base 53, the surrounding areas thereof are elastically deformed inward easily so that the protrusions 53*a*, 53*b* are dented.

Further, with the paper detecting unit 50 mounted in the groove 41, the protrusion 53*a* is fitted into any of the concaves 41*c* on one sidewall of the groove 41, and the protrusion 53*b* is fitted into any of the concaves 41*d* on the other sidewall.

Figure 5A:
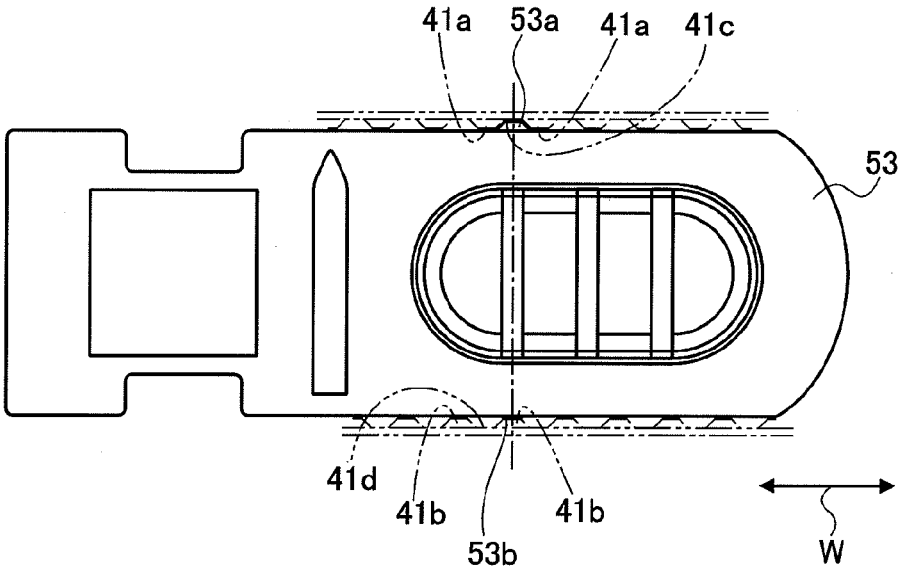

Since the protrusions 53*a*, 53*b* are aligned with each other in the paper width direction W as shown in FIG. 4B, while the protrusion 53*a* is fitted into the concave 41*c* on one sidewall of the groove 41, the other protrusion 53*b* is pressed by the convex 41*b* on the other sidewall and elastically deformed inward along the width of the base 53 or in a direction orthogonal to the paper width direction W so that it is not fitted into the concave 41*d*, as shown in FIG. 5A.

Figure 5B:
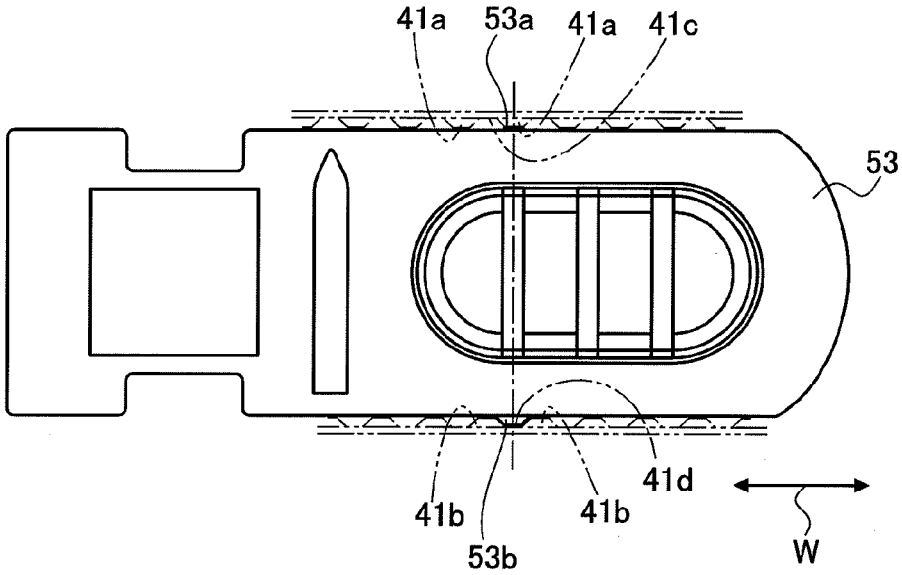
FIG. 5B shows that of the lower-side protrusion and the lower-side concaves.

Likewise, while the other protrusion 53*b* is fitted into the concave 41*d* on the other sidewall of the groove 41, the protrusion 53*a* is pressed by the convex 41*a* on the one sidewall and elastically deformed inward along the width of the base 53 so that it is not fitted into the concave 41*c*, as shown in FIG. 5B.

Thus, while the base 53 is being moved along the length of the groove 41 or in the paper width direction W, the protrusions 53*a*, 53*b* are alternatively fitted into the corresponding concaves 41*c*, 41*d* of the waveforms on the sidewalls of the groove 41.

Then, at every fitting, that is, at a moving distance P/2 of the base 53, the concave 41*c* and the protrusion 53*a* or the concave 41*d* and the protrusion 53*b* hit each other, generating clicking noise or vibration. Thereby, the operator can hear a clicking noise or feel a sense of clicking at every moving distance of P/2.

Thus, the protrusions 53*a*, 53*b* of the paper detecting unit 50 and the waveforms as the convexes 41*a*, 41*b* and concaves 41*c*, 41*d* of the guide plate 40 constitute a click generator to allow the operator to hear and feel clicks at positions where the paper detecting unit 50 should be stopped or fixed.

The respective engagements of the protrusions 53*a*, 53*b* of the base 53 and the concave 41*c*, 41*d* of the groove 41 are set to be weak enough to be easily released by normal amount of force applied to move the base 3 in the paper width direction W and allow the operator to feel a sense of clicking but not so strong to prevent the movement of the base 53.

Figure 6A:
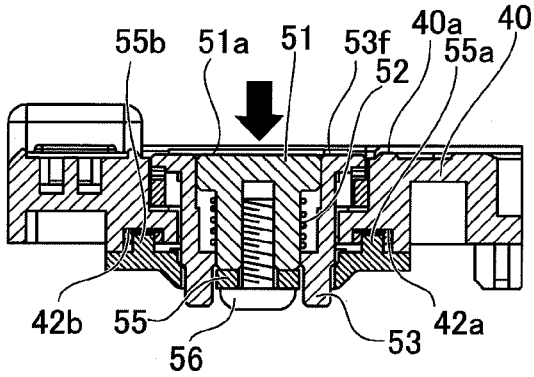
Figure 6B:
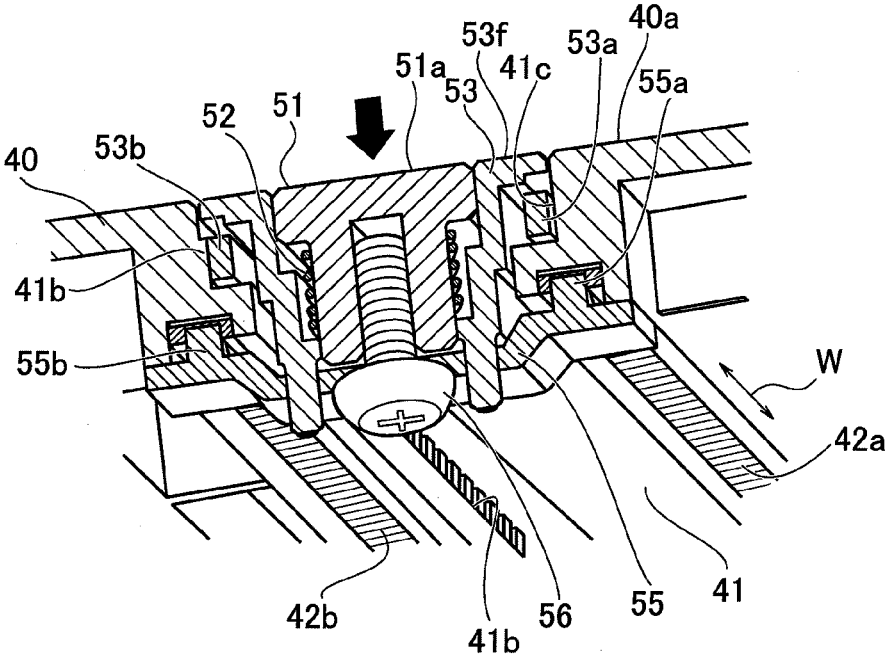
FIG. 6B is a perspective view of the same as seen from obliquely downward along the A to A line.

In FIG. 6B a large number of chases 42*a* and chases 42*b* are formed at a pitch of P/2 in two belt-like areas near the groove 41 on the bottom face of the guide plate 40, respectively. These chases 42*a*, 42*b* are formed at the same positions in the paper width direction W.

Further, the latch plate 55 joined with the operation button 51 of the paper detecting unit 50 from below includes two arms extending in a direction orthogonal to the paper width direction W and placing the screw 56 in-between them. The two arms have respective protrusions 55*a*, 55*b* as engaging element at the same positions formed on the top face in the paper width direction W to engage with the chases 42*a*, 42*b* of the guide plate 40.

Figure 8A:
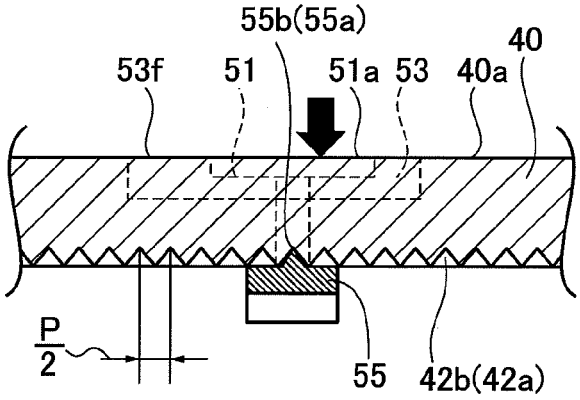

As shown in FIGS. 6A, 6B and 8A, while the operation button 51 is free from a press-down force, the latch plate 55 is biased upward together with the operation button 51 by a bias force of the coil spring 52 disposed between the operation button 51 and the base 53 so that both the protrusions 55*a*, 55*b* of the latch plate 55 are engaged with the corresponding chases 42*a*, 42*b* of the guide plate 40.

The total strength of the respective engagements of the protrusions 55*a*, 55*b* and chases 42*a*, 42*b* is defined by the elastic force of the coil spring 52, the depth and profile shape of the chases 42*a*, 42*b*, the length and profile shape of the protrusions 55*a*, 55*b* and the like, so as not to be released by a normal amount of force applied to the paper detecting unit 50 for moving the base 53 in the paper width direction W.

Accordingly, the latch plate 55 is in the engaging position in which the paper detecting unit 50 is fixed at a predetermined position along the groove 41 of the guide plate 40, so that the paper detecting unit 50 is prevented from moving in the paper width direction W due to an operator's unintended touch or else.

Figure 7A:
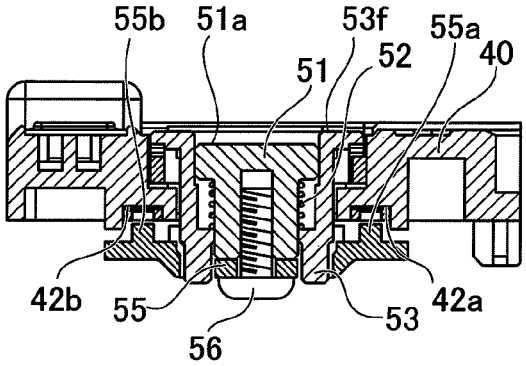
Figure 7B:
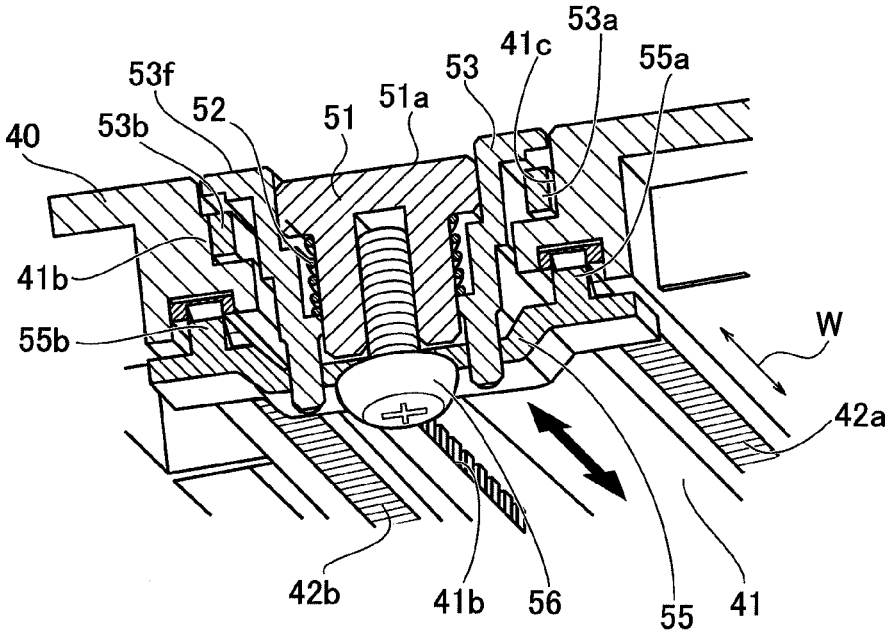
FIG. 7B is a perspective view of the same as seen from obliquely downward along the A to A line.
Figure 8B:
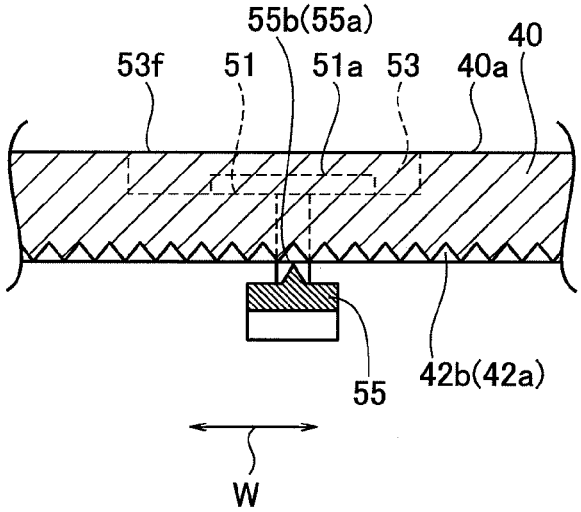
FIG. 8B is a perspective view of the same in the release position released from the fixation with the guide plate along the B to B line.

Meanwhile, upon the operator's press-down to the operation button 51 against the bias force of the coil spring 52, the latch plate 55 is pressed down along with the operation button 51 to release the engagement of the protrusions 55*a*, 55*b* of the latch plate 55 and the chases 42*a*, 42*b* of the guide plate 40 as shown in FIGS. 7A, 7B, 8B.

The latch plate 55 is in a release position in which the paper detecting unit 50 is released from the fixation to the groove 41 of the guide plate 40. Therefore, the operator can easily move the paper detecting unit 50, which is stopped only by the weak engagement of the protrusions 53*a*, 53*b* and concaves 41*c*, 41*d*, along the length of the groove 41 by keeping pressing the operation button 51 and applying a normal operation force to the paper detecting unit 50 in the paper width direction W.

While the paper detecting unit 50 is moving along the groove 41, the operator can hear clicking noise and feel a sense of clicking at P/2 pitch from the engagement of the protrusion 53*a* and concave 41*c* and the protrusion 53*b* and the concave 41*d*.

This makes it possible for the operator to easily know by the clicking the right position to stop the paper detecting unit 50 along the length of the groove 41 in unit of the pitch P/2.

Then, when the operator releases the operation button 51 after stopping the paper detecting unit 50 at the right position, the operation button 51 is automatically moved upward by the bias force of the coil spring 52 together with the latch plate 55 and returned to the position in FIG. 7A, 7B, 8A. Thereby, the protrusions 55*a*, 55*b* of the latch plate 55 are engaged with the chases 42*a*, 42*b* of the guide plate 40.

Thus, the operator can move the latch plate 55 to the engaging position by simply removing his/her finger from the operation button 51 without an additional operation. With the latch plate 55 in the engaging position, the paper detecting unit 50 is prevented from moving along the length of the groove 41, even upon receipt of a small amount of load from an operator's unintentional touch or the like.

As described above, according to the paper detecting device 30 in the present embodiment, it is possible to surely stop the paper detecting unit 50 at a predetermined position along the length of the groove 41 of the guide plate 40 by the engagement of the protrusions 55*a*, 55*b* of the paper detecting unit 50 and the chases 42*a*, 42*b* of the guide plate 40, and to smoothly move the paper detecting unit 50 when needed by a simple operation as merely pressing down the operation button 51 to release the engagement and applying a force to the paper detecting unit 50.

In addition, the paper detecting device 30 can provide the operator with an indication of the right position to stop the paper detecting unit 50 as clicking noise and a sense of clicking by the engagement of the protrusions 53*a*, 53*b* of the paper detecting unit 50 and the concaves 41*c*, 41*d* of the guide plate 40.

Needless to say that the protrusions 55*a*, 55*b* of the latch plate 55, the chases 42*a*, 42*b* of the guide plate 40, the protrusions 53*a*, 53*b* of the base 53, and the concave 41*c*, 41*d* of the guide plate 40 are arranged to allow their respective engagements.

Further, in the paper detecting unit 50 the surrounding portions of the protrusions 53*a*, 53*b* are configured to be elastically deformed to fit into the concaves 41*c*, 41*d* of the guide plate 40 with clicking noise. Alternatively, the convexes 41*a*, 41*b* of the guide plate 40 can be configured to be elastically deformable to fit with the protrusions 53*a*, 53*b*.

Furthermore, in paper detecting device 30 the concaves 41*c*, 41*d* of the two waveforms are formed at the pitch P on both the inner faces of the guide plate 40, shifted from each other in phase by 180 degrees, thereby creating the distance P/2 to give the operator a sense of clicking while the paper detecting unit 50 is moving in the paper width direction W. Therefore, it is unnecessary to reduce the pitch P of each waveform and avoid an increase in manufacturing costs for preparing smaller pitch waveforms.

Further, the paper detecting device 30 is configured that with the paper detecting unit in the engaging position, the top face of the paper detecting unit 50 or the top face 53*f* of the base 53, and the top face 51*a* of the operation button 51 come at almost the same height as that of the top face 40*a* of the guide plate 40 as shown in FIGS. 6A, 6B, 8A. This makes it possible to prevent the roll paper 200 from being jammed when passing on the top face 40*a* of the guide plate 40.

Furthermore, an antiskid element 51*b* is formed on the top face 51*a* of the operation button 51 to slightly protrude therefrom and extend in a direction orthogonal to the paper width direction W, as shown in FIGS. 2-3. This makes it easier for the operator to press down the operation button 51 to the release position and move the paper detecting unit 50 in the paper width direction W without his/her finger slipping thereon.

The present embodiment has described an example where the paper detecting device 30 includes the transmissive type optical sensor 54*a* as the paper detecting element. However, the present invention should not be limited to such an example. It can be configured to include a reflective type optical sensor (photo reflector) or a mechanical, electrical, or magnetic detector instead of the optical detector.

Further, according to the paper detecting device 30, the click generator can be simply structured of the waveforms (convexes 41*a*, 41*b* and concaves 41*c*, 41*d*) of the guide plate 40 and the protrusion 53*a* of the paper detecting unit 50.

According to the thermal printer 100 incorporating the paper detecting device 30, it is made possible to surely prevent the paper detecting unit 50 from unintentionally moving while it is stopped at the proper position in the paper width direction W in line with the size of the roll paper 200 in use, even if the operator accidentally touches the paper detecting unit 50 for replacing the rolling paper 200 or else with the cover 60 opened (FIG. 1B).

Moreover, when the type of the roll paper 200 in use, for example, width, is changed, it is possible to smoothly adjust the position of the paper detecting unit 50 in the paper width direction W in line with the new width by a simple operation as merely pressing down the operation button 51 to move it along the length of the groove 41.

In addition, in moving the paper detecting unit 50, the operator can reliably know the right position to stop it from clicking noise and a sense of clicking by the engagement of the protrusions 53*a*, 53*b* and the concaves 41*c*, 41*d*.

The printer according to one embodiment of the present invention is applicable to various types of printer such as an inkjet printer, a dot matrix printer in addition to a thermal printer.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A paper detecting device comprising:
- a paper detecting element; and
- a guide element having a path along which said paper detecting element is movable;
- wherein at least one of said paper detecting element and said guide element includes:
  - an engaging element configured to be movable between an engaging position, in which said paper detecting element is fixed in position on said path, and a release position, in which said paper detecting element is released from being fixed in position on said path; and
  - a click generator configured to click as said paper detecting element is moved along said path so as to allow determination of a correct stopping position on said path.

2. The paper detecting device according to claim 1, further comprising a bias element for biasing said engaging element to the engaging position.

3. The paper detecting device according to claim 2, wherein said engaging element includes an operation element for receiving a force to move said engaging element to the release position against a biasing force applied by said bias element, said operation element including an antiskid element extending in a direction orthogonal to said path.

4. The paper detecting device according to claim 1, wherein said click generator comprises:
- an uneven portion having convexes and concaves alternatively formed on said guide element; and
- a protrusion formed on said paper detecting element to fit into said concaves of said uneven portion.

5. The paper detecting device according to claim 1, wherein said click generator comprises a pair of uneven portions facing each other, each of said uneven portions having convexes and concaves alternatively formed on said guide element, said pair of uneven portions being formed so that said convexes and concaves of a first one of said pair of uneven portions are shifted from said convexes and concaves of a second one of said pair of uneven portions in phase by ½ pitch.

6. A printer comprising:
- a print unit;
- a paper carrier for holding paper to be printed on by said print unit;
- a paper detecting device including:
  - a paper detecting element; and
  - a guide element having a path along which said paper detecting element is movable;
  - wherein at least one of said paper detecting element and said guide element includes:
    - an engaging element configured to be movable between an engaging position, in which said paper detecting element is fixed in position on said path, and a release position, in which said paper detecting element is released from being fixed in position on said path; and
    - a click generator configured to click as said paper detecting element is moved along said path so as to allow determination of a correct stopping position on said path; and
- a printer body accommodating said paper carrier and said paper detecting device.

7. The printer according to claim 6, wherein said paper detecting device further includes a bias element for biasing said engaging element to the engaging position.

8. The printer according to claim 7, wherein said engaging element includes an operation element for receiving a force to move said engaging element to the release position against a biasing force applied by said bias element, said operation element including an antiskid element extending in a direction orthogonal to said path.

9. The printer according to claim 6, wherein said click generator comprises:
- an uneven portion having convexes and concaves alternatively formed on said guide element; and
- a protrusion formed on said paper detecting element to fit into said concaves of said uneven portion.

10. The printer according to claim 6, wherein said click generator comprises a pair of uneven portions facing each other, each of said uneven portions having convexes and concaves alternatively formed on said guide element, said pair of uneven portions being formed so that said convexes and concaves of a first one of said pair of uneven portions are shifted from said convexes and concaves of a second one of said pair of uneven portions in phase by ½ pitch.

* * * * *